United States Patent [19]

Meyer

[11] Patent Number: 4,480,374

[45] Date of Patent: Nov. 6, 1984

[54] COMMUNICATION PLUG CONNECTION TOOL

[75] Inventor: Daniel Meyer, Hector, Minn.

[73] Assignee: Communication Systems, Inc., Hector, Minn.

[21] Appl. No.: 435,899

[22] Filed: Oct. 22, 1982

[51] Int. Cl.[3] ..... H01R 43/04

[52] U.S. Cl. ..... 29/566.4; 7/131; 29/33 M; 29/751; 83/588

[58] Field of Search ..... 29/566.4, 750, 33 M, 29/751, 752, 758; 83/590, 588; 81/428 R; 7/132, 158, 130, 131, 133, 134

[56] References Cited

U.S. PATENT DOCUMENTS

| | | | |
|---|---|---|---|
| 5,803 | 3/1874 | Walker | 83/590 X |
| 3,553,999 | 1/1971 | Rommel | 29/752 X |
| 3,797,092 | 3/1974 | Einarson | 29/758 X |
| 3,860,316 | 1/1975 | Hardesty | 339/91 |
| 4,429,451 | 2/1984 | Angelico | 29/566.4 |

OTHER PUBLICATIONS

*Hand Assembly Tool for Modular Plugs,* Western Electric Technical, Digest No. 53, Jan. 1979.

Modular Crimping Tool Instructions by Futureonics, Inc.

*Primary Examiner*—Z. R. Bilinsky

*Attorney, Agent, or Firm*—Kinney & Lange

[57] ABSTRACT

A tool connects plugs to the ends of communication wires and in particular is used with modular type communication plugs. The tool includes two relatively pivoted handle members that are restrained in the amount that they can be separated and which include a punch that will positively force connector tangs of a plug positioned in a provided receptacle in the tool into the ends of wires of a communication cord to properly and positively connect the individual wires of the cord to the proper terminal of the plug as the handles are squeezed. The tool also has knives which can be used for stripping a specified length from the end of the outer sheath from the insulated wires before inserting the wires into a plug carried in a close fitting receptacle in one of the handle members. The punch has separated lands or bars that separately bear against each contact tang of the plug and in this way force the connecting tang into the individual communication wires.

6 Claims, 10 Drawing Figures

Fig. 10
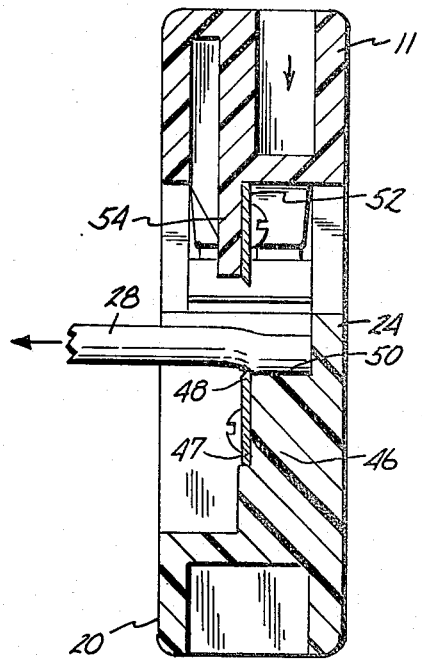
Fig. 8
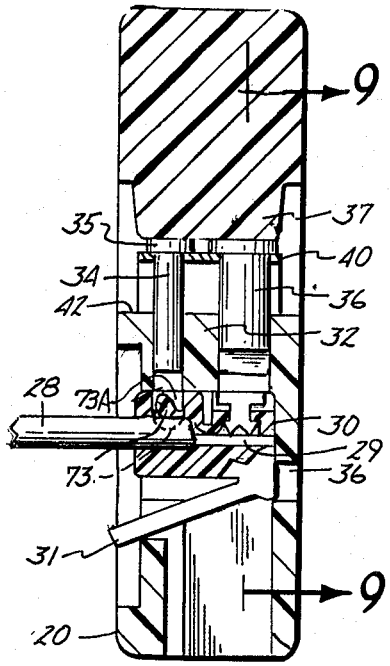
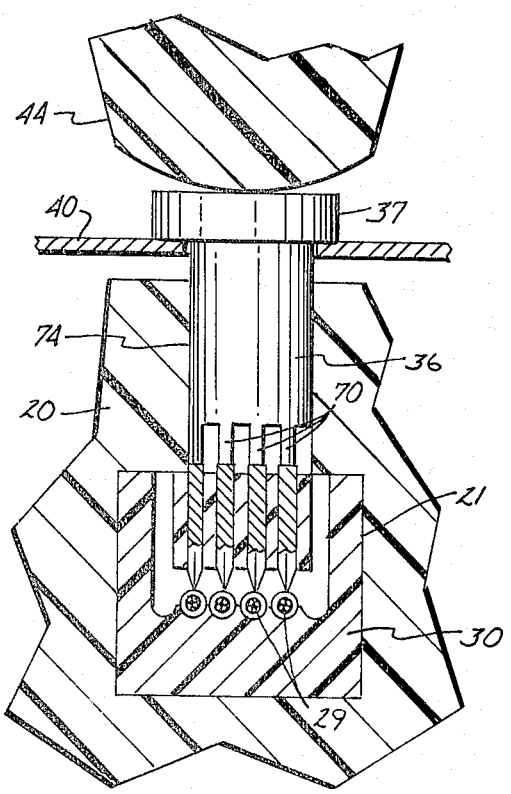
Fig. 9

COMMUNICATION PLUG CONNECTION TOOL

BACKGROUND OF THE INVENTION

1. Field of the Invention

The present invention relates to hand held tools for connecting modular plugs to the wires of a communication cord.

2. Description of the Prior Art

In the prior art, hand held termination tools have been advanced which have two pivoting handle members, but which do not provide lands formed as integral parts of the handles that bear separately on the individual connector tangs in the plug and exert a force to push each tang into one of the individual wires. The prior art devices further are somewhat difficult to manipulate, some do not have wire stripping capability nor do they hold plugs in position securely. The plugs used are generally of the type shown in U.S. Pat. No. 3,860,316, issued Jan. 14, 1975 to Edwin Hardesty and assigned to Western Electric Company, Incorporated.

SUMMARY OF THE INVENTION

The present invention relates to a hand held tool for connecting communication modular plugs, in particular at the ends of communication equipment cords that have a plurality of individual conductors. The tool includes a pair of pivoted handles carrying a knife for stripping the ends of the communication cord and the individual conductors or wires. A receptacle for receiving a plug and holding it in position to be installed on the cord is provided in one handle of the tool. The tool carries a punch positioned in proper location in relation to the plug receptacle and spring loaded away from the plug receptacle. When the termination tool handles are squeezed together manually, the punch is actuated by a lug on the other tool handle to force connecting tangs on the plug into the individual conductors of the communication cord and also punch a strain relief lug from the plug against the cord, and thus terminate the cord with the plug attached to the proper respective conductors for the contacts carried by the plug.

The termination tool is easily operated, and includes a punch that has individual lands that are used for individually operating the connector tangs for each of the conductors so that there is a good connection between the individual conductors and the contacts in the plug.

BRIEF DESCRIPTION OF THE DRAWINGS

FIG. 8 is a view taken as on line 8—8 in FIG. 2;

FIG. 9 is a view taken as on line 9—9 in FIG. 8 with a punch moved partially toward working position; and FIG. 10 is a sectional view taken as on line 10—10 in FIG. 2.

DETAILED DESCRIPTION OF THE PREFERRED EMBODIMENTS

Figure 1:
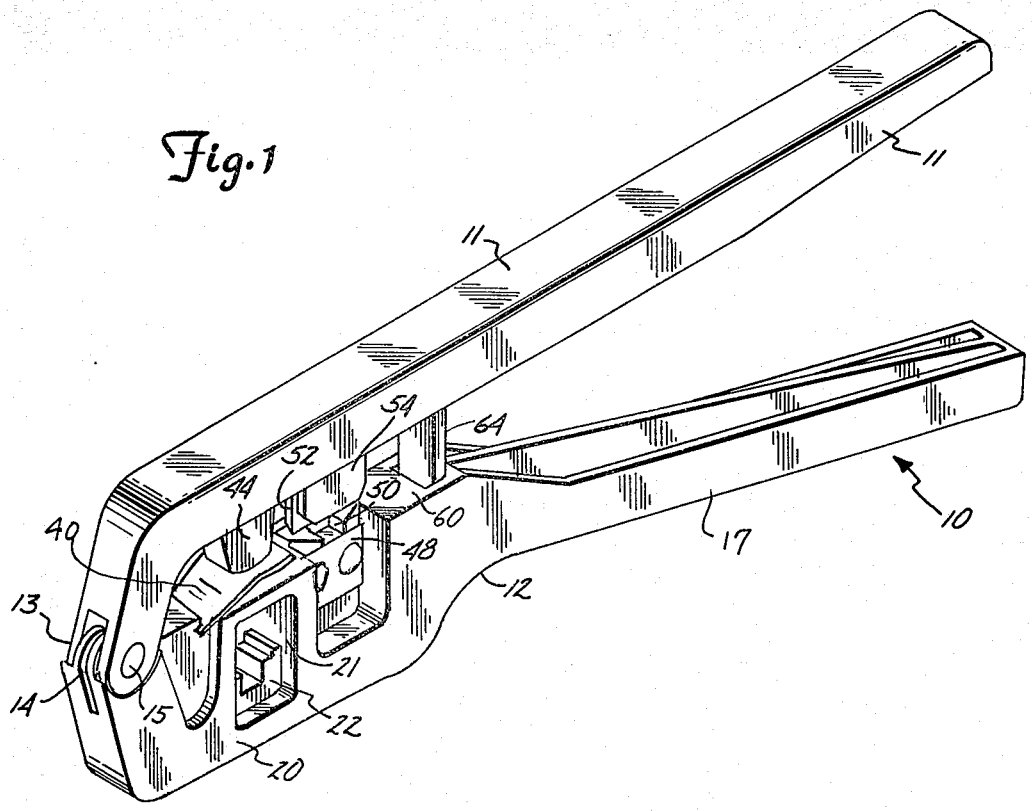
FIG. 1 is a perspective view of a communication plug connection tool made according to the present invention.

A connection tool indicated generally at 10 is a hand held plier-like tool that includes a first handle member 11 and a second handle member 12. One end of the first handle member 11 is slotted as at 13 and the individual flanges or ears formed fit over a pair of ears 14 at the end of the second handle member 12. The handle members 11 and 12 are held together for pivoting movement with a pivot pin 15 that passes through the bifurcations 13 and the ears 14 to pivotally hold the handle members 11 and 12 together for pivoting about a transverse axis. The handle members each include a grip portion 16 and 17, respectively. The grip portion 17 diverges from the grip portion 16, as shown. The grip portion 17 is used for gripping with the fingers while the palm of the hand rests on the top of the grip portion 16. This provides for a natural type grip of the tool.

The handle member 12 has a mounting block portion 20 adjacent to the pivot pin 15, and this mounting block portion has a receptacle shown at 21 defined therein. The receptacle 21 opens to one side of the block portion 20, and includes support members 22 on the interior for supporting a communications plug 30 (see FIG. 8) in proper position when the plug is latched in place in support 22 with a latch tab 31. The latching is the same as latching a plug in a jack when in use. When latched the plug 30 fits closely adjacent to an inner wall 24 of the receptacle. The inner wall of the receptacle 21 has an aperture 26 therethrough which aligns with a lug on the plug 30 to provide adequate clearance, when a plug 30 is in position in the receptacle 21.

The receptacle 21 is also defined by an upper wall 32 that is part of the mounting block 20, and a pin 34 is slidably mounted in wall 32 for sliding movement along its central axis toward and away from a plug 30 mounted in the receptacle 21.

A punch member 36 is also slidably mounted in a provided aperture in the wall portion 32 adjacent the pin 34. Both the pin 34 and the punch 36 have head members 35 and 37, respectively, and a leaf spring 40 is positioned under both of the head members. One end of spring 40 fits snuggly into a slot in the upper surface 42 of the mounting block portion 20 and cantilevers outwardly. The spring 47 is retained in the slot and resiliently bends under loads and urges the head members of the pin 34 and punch 36 in direction away from the receptacle 21.

An actuator lug 44 is integrally formed with the handle member 11 in line with the pin 34 and the punch 36. The lug 44 is elongated in direction along the axes of the pin 15 and engages the heads of both the pin 34 and punch 36. When the unit is to be operated and the handles are squeezed together, the lug 44 will bear against the pin 34 and the punch 36 force them toward a plug 30 mounted in the receptacle 21. As will be explained this causes actuation of the members to connect a cord 28, and the individual conductors thereof to contacts of the plug 30.

Additionally, the mounting member 20 has a wall 46 recessed from the side in which receptacle 21 is defined, and which mounts a cutting blade 47 that has an edge 48. A communication cord 28 is laid over the edge 48 of the blade 47 and the end portion of the cord is positioned in a channel 50 with the cord end against a portion of the wall 24. A second cutting blade 52 is mounted on a wall 54 formed on the handle member 11, in line with the recess 46 and overlying the channel 50. The second cutting blade 52 aligns with the blade 48. When the handles 11 and 12 are closed or squeezed together, a cutting action is achieved with the blades which cuts through the outer sheath of the cord 28 positioned in the channel 50. The blades 48 and 52 will cut the exterior sheath on the cord so that the sheath can be stripped from the individual conductors easily. The blade edges are spaced about 0.040 inches apart when the handles are clamped together. The cord has a short length of the sheath removed and short lengths of the insulated conductors are exposed. The cord end thus can be easily inserted into the plug 30 that is to be attached to that end of the cord.

Figure 2:
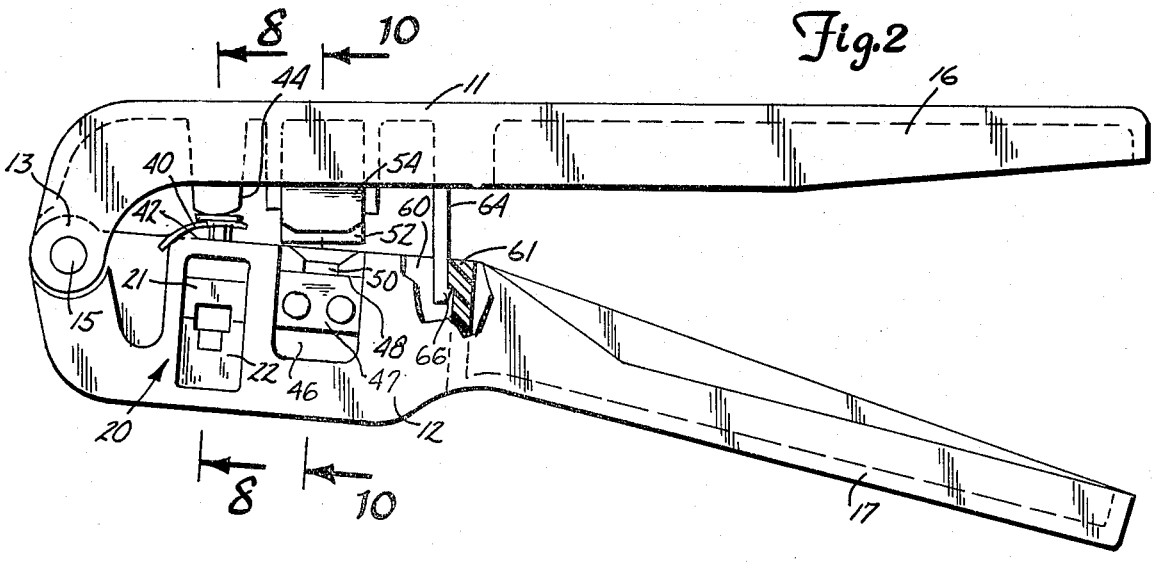
FIG. 2 is a side elevational view thereof with parts in section and parts broken away.
Figure 3:
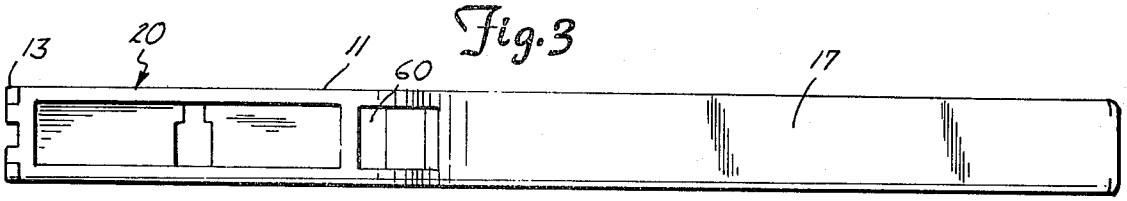
FIG. 3 is a bottom plan view thereof.
Figure 4:
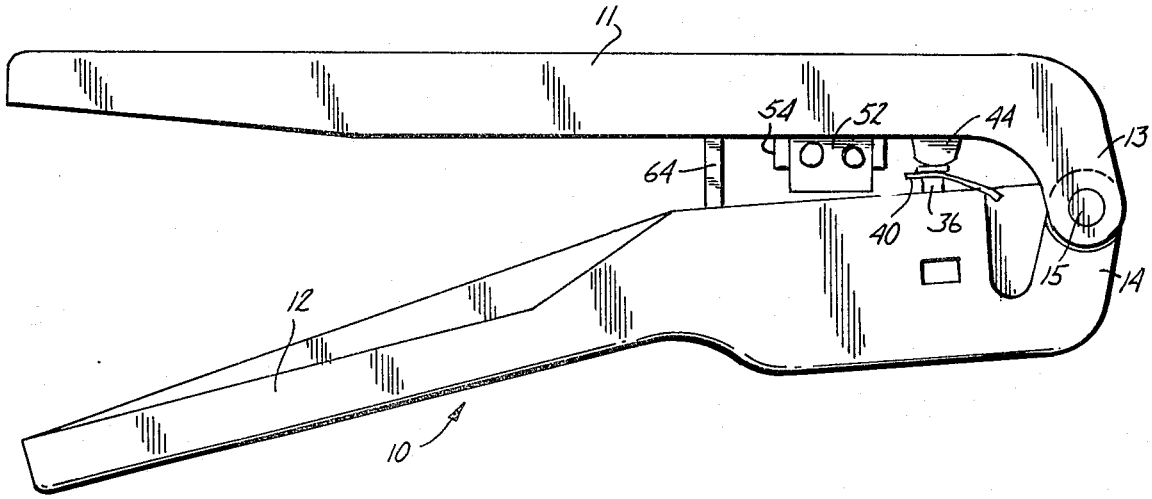
FIG. 4 is a side view taken from the opposite side from FIG. 2.
Figure 5:
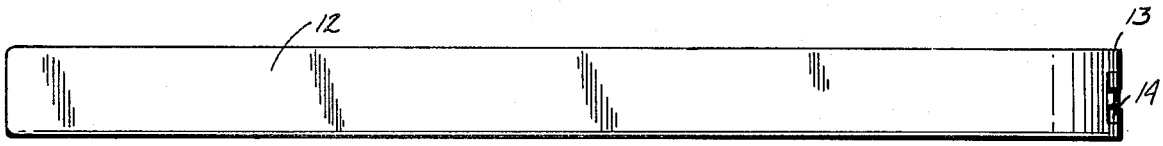
FIG. 5 is a top view thereof.
Figure 6:
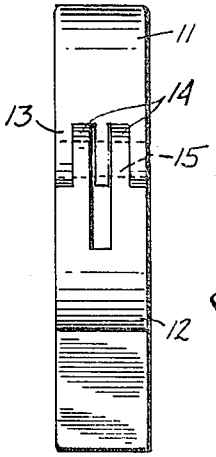
FIG. 6 is an end view taken from the end where the handles are pivoted together.
Figure 7:
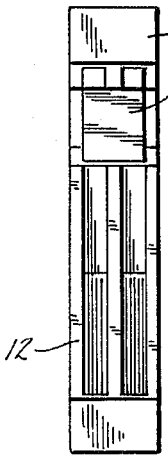
FIG. 7 is an end view of the termination tool of FIG. 1 taken looking toward the free ends of the handle.

The handle member 12 is provided with a through aperture or opening 60 (FIG. 2) that has a lug 61 formed near the end of the aperture adjacent the handle member 11. A spring type latch arm 64 is integrally formed with the handle member 11 and extends from the handle member. The latch arm 64 is aligned with and extends into opening 60 of arm 17. The latch arm 64 has a latch lip 66 which fits below the lug 61 and as shown the lug 61 and the lip 66 engage to hold the handle members from separating more than that shown in FIG. 2. However, the handle members 11 and 12 can be moved together by gripping them together as previously described, and the latch arm 64 merely moves further into the opening 60.

The punch 36 has an end surface that faces the plug 30 in the receptacle 21 comprising a plurality of parallel rails 70 that are spaced apart the proper distance and are of the proper width so that each of these rails aligns with one of the provided connecting tangs 72 in the unattached plug member 30 latched in place in the support 22. These tangs 72 are provided in a conventional plug as previously described, and are positioned in small slots in the plug body. The rails 70 are made so that they will fit into the slots of the plug body.

The plug 30, is, as stated shown in detail in U.S. Pat. No. 3,860,316 and comprises a plastic (polycarbonate) housing having a channel into which the end of cord 28, with the end portions of the individual insulated conductors 29, where the sheath has been removed, adjacent the inner end of the plug. The plug is made with a plurality of tangs 72 mounted in slots in the housing and the tangs each have sharpened prongs overlying an associated one of conductors 29 when the cord is placed in the plug 30. When originally manufactured the plug is made so that the tangs are rectracted and the cord can be inserted in the receptacle below the tangs (see FIGS. 8 and 9). The tangs 72 are each connected to a separate contact that mates with a contact in a jack with which the plug is to be used.

As shown schematically in FIG. 8, the plug 30 has a provided strain relief lug 73 mounted in a channel or passage 73A that is open at the top of the plug. The channel 73A aligns with the pin 34 when the plug is positioned in the support 22. The lug 73 is initially positioned in a retracted position up in the channel 73A as shown and as the handles 11 and 12 are moved together the pin 34 will enter the channel 73A and push lug 73 toward the cord 28, which is laying in the plug. This portion of the cord below channel 73A still has the sheath in place, and thus the lug 73 will be aligned with the portion of the cord having a sheath on it. The lug 73 is shown in dotted lines in its engaged or working position.

The rails 70 of punch 36 align with and push against the upper ends of the tangs 72 and will force the sharp ends of the tangs into the ends of the individual conductors 29 of a cord 28 being connected to the plug 30 as the handles are squeezed together. These sharp ends penetrate through the insulation on the ends of the conductors 29 to make electrical connection. The tangs are also initially raised or retracted from the position shown in FIG. 8 and when the handles are squeezed together the tangs are pushed down to make contact as shown in FIG. 8.

The punch 70 has a flat side surface (a chordal surface) indicated at 74 which keeps the punch properly oriented rotationally so that the rails 70 are always positioned parallel to and aligned with the plane of the tangs 72 (in the slots in which the tangs are mounted) and with the longitudinal length of the individual conductors.

The handle members 11 and 12 are squeezed together manually, with a plug 30 and cord 28 in position in the support 22, the actuator lug 44 will bear against the pin 34 and punch 36 and force the pin and the punch toward a plug 30 in support 22. The pin 34 enters the channel or passageway 73A and bears against the lug 73. The lug 73 is rolled or moved down the channel 73A so that it engages the cord 28 and is jammed or wedged down against the cord to form a strain relief to hold the cord in position.

At the same time, punch 36 is moved so that the rails 70 push the tangs 72 down to pierce the insulation on conductors 29 and electrically connected tangs to the conductors. Releasing the handles of the tool permits the handles to separate so that the pin 34 and the punch 36 are withdrawn from the plug and the plug can then be removed. The plug 30 has a spring lock tab 31 that latches the plug in place in support 22 in the same manner that the plug is latched into an ordinary jack used in telephones and the like. The lock tab 31 is released for removal of the lug 30 in the same manner as removal of a modular plug from a modular jack.

The molded tool 10 is easy to use, and low cost but yet is very accurate because the parts are held properly positioned with the pivot pin and the guide latch arm 64. The handles will not separate excessively, and thus they can be easily gripped. Additionally, the cutting blades 48 and 54 are held properly aligned, and the spring member 40 keeps the handle separated and holds the pin 34 and the punch 36 away from the plug being connected to the cord whenever the pressure is relaxed from the handles.

The movement of the handles 11 and 12 toward each other is stopped by the lug 44 bearing on the heads of pin 34 and punch 36 and bottoming out spring 40 against the surface of mounting block portion 20 on which the spring rests. This determines the stopped spacing on the cutting blades 47 and 52 as well.

What is claimed is:

1. A hand tool for connecting a communications plug to a communications cord having a plurality of conductors in such cord arranged in a known relationship, said tool comprising a pair of handle members pivotally mounted together adjacent one end thereof, and diverging so that the opposite ends of the handle members can be moved toward and away from each other, a first of the handle members having an integral mounting block portion between the pivot and the opposite end thereof, said block portion having a receptacle formed therein for receiving a communication plug and cord which are to be connected, said receptacle having a laterally facing plug receiving opening on one side of the block portion so a plug to be worked on may be inserted in direction generally parallel to the pivotal axis of handle members, said block portion further having a pair of passageways extending from a surface of the first handle member facing a second of the handle members and opening into the receptacle, said passageways being aligned with desired portions of a plug held in said receptacle and extending at substantially right angles to the direction of insertion of a plug into the receptacle, a pin slidably mounted in one of said passageways in said block, a punch slidably mounted in the other of said passageways in said block, said pin and punch each having a head member positioned on the exterior surface of the block on a side of the block facing the second handle member and adjacent the second handle member, means coupled to said pin and punch for causing movement thereof in direction away from said receptacle when the handle members separate including a spring for urging the pin and punch to move away from the receptacle and the handle members to separate, and an actuator lug mounted on the second of said handle members adapted to slidably engage and bear against both the head of the pin and the head of the punch, said handle members being movable toward each other to force the pin and the punch toward a plug held in the receptacle to engage members on the plug and connect the cord to the plug.

2. The apparatus of claim 1 wherein said spring is a leaf spring having a first portion mounted on the hand tool and a second portion positioned under the heads of the pin and punch and urging the pin and punch away from the receptacle.

3. The apparatus of claim 1 and latch means to hold said handle members from separating more than a desired distance.

4. The apparatus of claim 3 wherein said latch means comprises a latch arm mounted on one of said handle members, and having a latch lip formed thereon, an aperture formed on the other of said handle members of size to receive said latch arm, one side surface defining the aperture being formed to provide a latch shoulder, said latch shoulder and latch lip engaging to prevent movement of said handle members more than a desired distance away from each, and said latch arm moving away from said latch shoulder when the handle members are moved together.

5. The apparatus of claim 1 wherein said mounting block of said first handle member has means to mount a cutting blade having an edge opening to and facing the second handle member, and means on said second handle member mounting a second cutting blade having an edge facing the first handle member, said first and second cutting blades cooperating to cut a cord used with a plug positioned between the blades as the handle members are pivoted together.

6. The apparatus of claim 5 wherein said mounting block member includes a channel formed adjacent the first blade having an end wall against which a cord can be abutted when the cord is positioned over said first mentioned blade, said handle members being adapted to be squeezed together so that the blade members cut a sheath on said cord without damaging the individual conductors of the cord to permit stripping the sheath from an end portion of the cord.

* * * * *